US011245188B2

(12) United States Patent
Chiang et al.

(10) Patent No.: US 11,245,188 B2
(45) Date of Patent: Feb. 8, 2022

(54) ANTENNA DEVICE HAVING A DIPOLE ANTENNA AND A LOOP SHAPED ANTENNA INTEGRATED FOR IMPROVING ANTENNA BANDWIDTH AND ANTENNA GAIN

(71) Applicant: MEDIATEK INC., Hsin-Chu (TW)

(72) Inventors: Chung-Hsin Chiang, Hsin-Chu (TW); Yeh-Chun Kao, Hsin-Chu (TW); Shih-Huang Yeh, Hsin-Chu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 16/240,795

(22) Filed: Jan. 7, 2019

(65) Prior Publication Data

US 2019/0214741 A1 Jul. 11, 2019

Related U.S. Application Data

(60) Provisional application No. 62/616,027, filed on Jan. 11, 2018.

(51) Int. Cl.
*H01Q 5/35* (2015.01)

(52) U.S. Cl.
CPC ..... *H01Q 5/35* (2015.01)

(58) Field of Classification Search
CPC ..... H01Q 5/30; H01Q 5/307; H01Q 5/342; H01Q 5/35; H01Q 5/357; H01Q 5/371; H01Q 21/24; H01Q 21/28; H01Q 9/16; H01Q 9/26; H01Q 9/065; H01Q 9/18; H01Q 9/20; H01Q 9/22; H01Q 9/24; H01Q 9/265; H01Q 7/00; H01Q 7/005; H01Q 7/02; H01Q 7/04; H01Q 7/06; H01Q 7/08; H01Q 5/00; H01Q 5/10; H01Q 5/20; H01Q 5/314; H01Q 5/321; H01Q 5/328; H01Q 5/335; H01Q 5/364; H01Q 5/378; H01Q 5/385; H01Q 5/392; H01Q 5/40; H01Q 5/42; H01Q 5/45; H01Q 5/47; H01Q 5/48; H01Q 5/49; H01Q 5/50; H01Q 1/36

See application file for complete search history.

(56) References Cited

U.S. PATENT DOCUMENTS 5,198,826 A * 3/1993 Ito ..... H01Q 1/38 343/713
6,946,958 B2 * 9/2005 Gundlach ..... G06K 19/0724 340/13.27
7,102,577 B2 * 9/2006 Richard ..... H01Q 1/242 343/702

(Continued)

*Primary Examiner* — Hoang V Nguyen
(74) *Attorney, Agent, or Firm* — Winston Hsu

(57) ABSTRACT

An antenna device includes a first dipole antenna, a second loop shaped antenna, a first feed line and a second feed line. The first dipole antenna operates at a first frequency band. The first dipole antenna includes a first portion and a second portion. The second loop shaped antenna operates at a second frequency band different from the first frequency band. A first terminal of the second loop shaped antennal is coupled to a second terminal of the first portion of the first dipole antenna. A second terminal of the second loop shaped antenna is coupled to a first terminal of the second portion of the first dipole antenna. The first feed line is coupled to the second terminal of the first portion of the first dipole antenna. The second feed line is coupled to the first terminal of the second portion of the first dipole antenna.

19 Claims, 9 Drawing Sheets

(56) References Cited

U.S. PATENT DOCUMENTS

| | | | | |
|---|---|---|---|---|
| 7,760,150 | B2 * | 7/2010 | Sato | H01P 1/15 343/724 |
| 7,868,836 | B2 * | 1/2011 | Vendik | H01Q 7/00 343/726 |
| 9,761,935 | B2 * | 9/2017 | Ross, III | H01Q 1/50 |
| 2009/0160717 | A1 * | 6/2009 | Tsutsumi | H01Q 7/00 343/726 |

* cited by examiner

ANTENNA DEVICE HAVING A DIPOLE ANTENNA AND A LOOP SHAPED ANTENNA INTEGRATED FOR IMPROVING ANTENNA BANDWIDTH AND ANTENNA GAIN

CROSS REFERENCE TO RELATED APPLICATIONS

This application claims priority to provisional Patent Application No. 62/616,027, filed 2018 Jan. 11, and incorporated herein by reference in its entirety.

BACKGROUND

In the application of an advanced communications system, signals may be transceived on a plurality of frequency bands. For example, in a 5G NR network system, signals may be transceived at a dual frequency band. The dual frequency band can include a first band and a second band. For example, the first band and the second band can be (but not limited to) 24. 25-29.5 GHz (gigahertz) and 37-43.5 GHz. For this purpose, a proper antenna structure supporting a dual band is required.

FIG. 1 illustrates an antenna device 100 according to the prior art. In FIG. 1, the antenna structure may be a 1×4 antenna array. The antenna device 100 can include a first antenna 110 to a fourth antenna 140 and a transceiver 180. As shown in FIG. 1, in order to transceive signals at a dual frequency band, the first antenna 110 and the third antenna 130 can operate at the first band, and the second antenna 120 and the fourth antenna 140 can operate at the second band. The transceiver 180 can include transceiver units 181 and 182. The transceiver unit 181 can be coupled to the first antenna 110 and the third antenna 130 for transceiving signals at the first band, and the transceiver unit 182 can be coupled to the second antenna 120 and the fourth antenna 140 for transceiving signals at the second band.

By means of the structure of FIG. 1, the transceiver 180 can transceive signals at a dual band mode. However, the structure of FIG. 1 requires four antennas. It is quite difficult to integrate the four antennas in a limited size and still have a good antenna gain, a good antenna bandwidth, and a good antenna isolation. This problem has led to more hardware requirements and an excessive hardware size.

SUMMARY

An embodiment provides an antenna device including a first dipole antenna, a second loop shaped antenna, a first feed line and a second feed line. The first dipole antenna is used to operate at a first frequency band. The first dipole antenna includes a first portion and a second portion. The first portion has a first terminal and a second terminal. The second portion has a first terminal and a second terminal. The second loop shaped antenna is used to operate at a second frequency band different from the first frequency band. The second loop shaped antenna includes a first terminal and a second terminal. The first terminal of the second loop shaped antennal is coupled to the second terminal of the first portion of the first dipole antenna. The second terminal of the second loop shaped antenna is coupled to the first terminal of the second portion of the first dipole antenna. The first feed line includes a first terminal coupled to the second terminal of the first portion of the first dipole antenna, and a second terminal. The second feed line includes a first terminal coupled to the first terminal of the second portion of the first dipole antenna, and a second terminal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
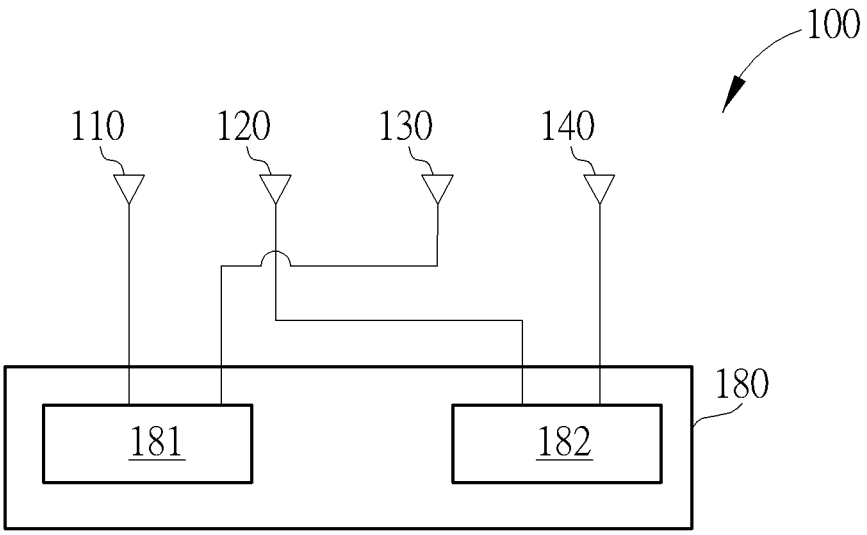
FIG. 1 PRIOR ART
FIG. 1 illustrates an antenna device according to the prior art.
Figure 2:
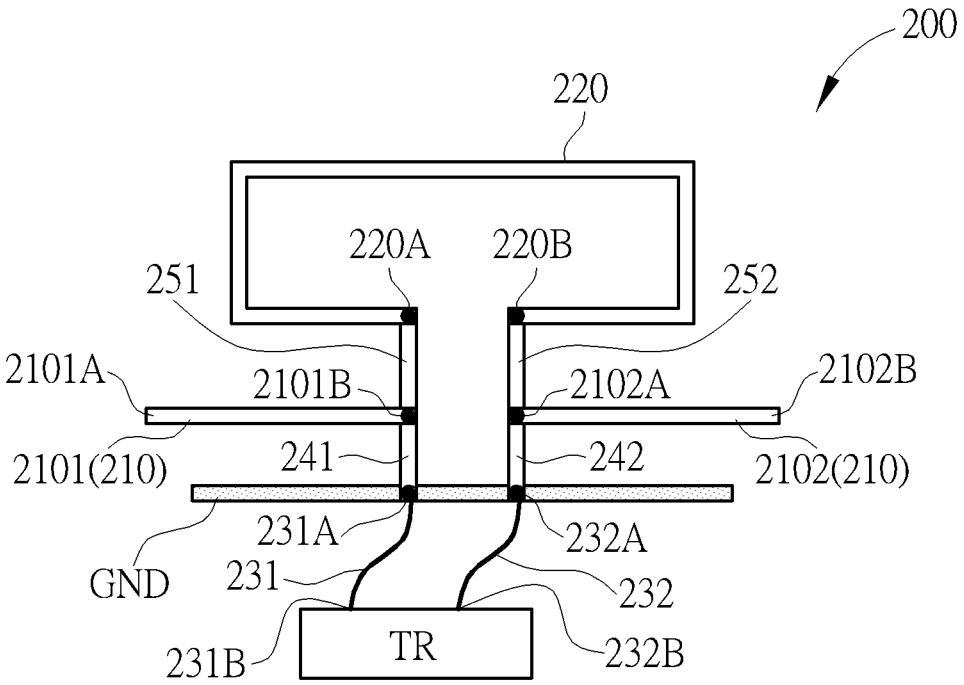
FIG. 2 illustrates an antenna device according to an embodiment.

FIG. 2 illustrates an antenna device 200 according to an embodiment of the disclosure. In FIG. 2, the antenna device 200 may be simplified to illustrate the principles of the design rather than providing fixed design details. The antenna device 200 may include a first dipole antenna 210 and a second loop shaped antenna 220, a first feed line 231 and a second feed line 232. The first dipole antenna 210 may be used to operate at a first frequency band. The first dipole antenna 210 may include a first portion 2101 and a second portion 2102. The first portion 2101 may have a first terminal 2101A and a second terminal 2101B. The second portion 2102 may have a first terminal 2102A and a second terminal 2102B. The second loop shaped antenna 220 may be used to operate at a second frequency band different from the first frequency band. The second loop shaped antenna 220 may include a first terminal 220A and a second terminal 220B. The first terminal 220A of the second loop shaped antennal 220 is coupled to the second terminal 2101B of the first portion 2101 of the first dipole antenna 210. The second terminal 220B of the second loop shaped antenna 220 is coupled to the first terminal 2102A of the second portion 2102 of the first dipole antenna 210.

The first feed line 231 may include a first terminal 231A coupled to the second terminal 2101B of the first portion 2101 of the first dipole antenna 210, and a second terminal 231B. The second feed line 232 may include a first terminal 232A coupled to the first terminal 2102A of the second portion 2102 of the first dipole antenna 210, and a second terminal 232B.

The second terminal 231B of the first feed line 231 and the second terminal 232B of the second feed line 232 may be coupled to a transceiver TR for transceiving signals transceived by the antennas 210 and 220. Hence, the transceiver TR may transceive signals on a dual band via the antenna device 200.

As shown in FIG. 2, the antenna device 200 may further include a first supporter 241 and a second supporter 242. The first supporter 241 may be disposed between the first terminal 231A of the first feed line 231 and the second terminal 2101B of the first portion 2101 of the first dipole antenna 210. The second supporter 2102 may be disposed between the first terminal 232A of the second feed line 232 and the first terminal 2102A of the second portion 2102 of the first dipole antenna 210. As shown in FIG. 2, the antenna device 200 may further include a first connector 251 and a second connector 252. The first connector 251 may be coupled between the first terminal 220A of the second loop shaped antenna 220 and the second terminal 2101B of the first portion 2101 of the first dipole antenna 210. The second connector 252 may be coupled between the second terminal 220B of the second loop shaped antenna 220 and the first terminal 2102A of the second portion 2102 of the first dipole antenna 210. According to an embodiment, the antennas 210 and 220, the connectors 251 and 252 and the supporters 241 and 242 may be monolithically formed in one piece. In FIG. 2, a ground plane GND is shown since the ground plane GND may be visible from a side view. However, the first terminal 231A of the first feed line 231 and the first terminal 232A of the second feed line 232 may not be electrically connected to the ground plane GND. In other words, the feed lines 231 and 232 may be insulated from the ground plane GND.

According to an embodiment, when the antenna device 200 operates in a single-ended mode, one of the first feed line 231 and the second feed line 232 may be used to transceive a signal, and another one of the first feed line 231 and the second feed line 232 may be connected to a reference ground.

According to another embodiment, when the antenna device 200 operates in a differential mode, one of the first feed line 231 and the second feed line 232 may be used to transceive a first signal. Another one of the first feed line 231 and the second feed line 232 may be used to transceive a second signal. The first signal and the second signal form a pair of differential signals. For example, the first signal and the second signal may be in antiphase.

According to an embodiment, a first projection length L1 from the first terminal 2101A of the first portion 2101 of the first dipole antenna 210 to the second terminal 2102B of the second portion 2102 of the first dipole antenna 210 may be substantially equal to n times half a first wavelength λ1. The first wavelength $\lambda_1$ may be corresponding to the first frequency band, and n is a positive integer greater than zero. For example, the first projection length L1 may be equal to one of ½λ1, λ1, 3/2λ1, etc.

Figure 3:
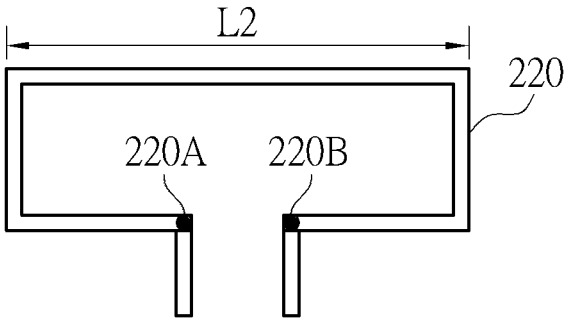
FIG. 3 illustrates the second loop shaped antenna of FIG. 2 according to an embodiment.

FIG. 3 illustrates the second loop shaped antenna 220 of FIG. 2 according to an embodiment of the disclosure. In FIG. 3, the antenna 220 may be illustrated from a side view or a top view. As shown in FIG. 3, the second loop shaped antenna 220 may be a folded dipole antenna, and a second projection length L2 of the second loop shaped antenna 220 may substantially equal tom times half a second wavelength λ2. The second wavelength λ2 may be corresponding to the second frequency band, and m may be a positive integer greater than zero. For example, the second projection length L2 in FIG. 3 may be equal to one of ½λ2, λ2, 3/2λ2, etc. The shape of the second loop shaped antenna 220 in FIG. 3 is merely an example instead of limiting the scope of embodiments.

Regarding FIG. 2 and FIG. 3, when the first projection length L1 is greater than the second projection length L2, the first wavelength λ1 is greater than the second wavelength λ2, and the first frequency band is lower than the second frequency band. For example, the first frequency band may be (but not limited to) between 24.25 to 29.5 GHz, and the second frequency band may be (but not limited to) between 37 to 43.5 GHz. In another case, when the first projection length L1 is smaller than the second projection length L2, the first wavelength λ1 is smaller than the second wavelength λ2, and the first frequency band is higher than the second frequency band. For example, the first frequency band may be (but not limited to) between 37 to 43.5 GHz, and the second frequency band may be (but not limited to) between 24.25 to 29.5 GHz.

Figure 4:
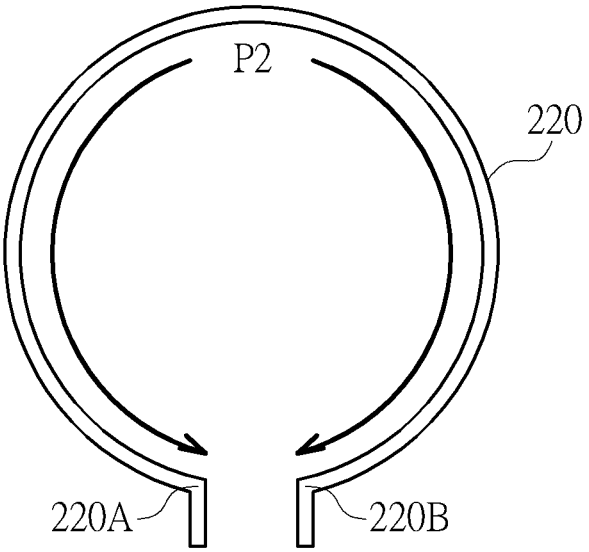
FIG. 4 illustrates the second loop shaped antenna of FIG. 2 according to another embodiment.
Figure 5:
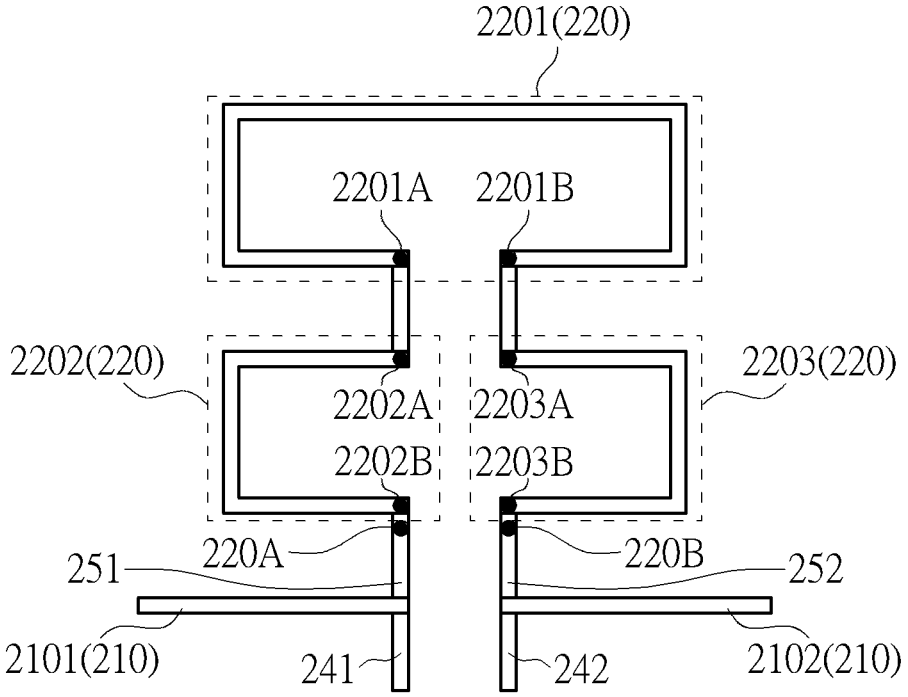
FIG. 5 illustrates the first dipole antenna and the second loop shaped antenna of FIG. 2 according to another embodiment.

FIG. 4 illustrates the second loop shaped antenna 220 of FIG. 2 according to another embodiment of the disclosure. In FIG. 4, the antenna 220 may be illustrated from a top view or a side view. As shown in FIG. 4, the second loop shaped antenna 220 may be a loop antenna, and a perimeter P2 of the second loop shaped antenna 220 may substantially equal to k times of a second wavelength λ2. The second wavelength λ2 may be corresponding to the second frequency band, and k is a positive integer greater than zero. For example, the perimeter P2 in FIG. 4 may be equal to one of λ2, 2λ2, 3λ2, etc. When the second loop shaped antenna 220 is a loop antenna, the second loop shaped antenna 220 may have a symmetrical shape such as a circle, a rhombus, a rectangle or a customized shape. In FIG. 5, an example of the second loop shaped antenna 220 with a customized shape is described.

FIG. 5 illustrates the first dipole antenna 210 and the second loop shaped antenna 220 of FIG. 2 according to another embodiment of the disclosure. In FIG. 5, the antennas 210 and 220 may be illustrated from a top view or a side view. The second loop shaped antenna 220 is a loop antenna with a customized shape, and the second loop shaped antenna 220 may include a first portion 2201, a second portion 2202 and a third portion 2203. The first portion 2201 may include a first terminal 2201A and a second terminal 2201B. The second portion 2202 may include a first terminal 2202A and a second terminal 2202B where the first terminal 2202A is coupled to the first terminal 2201A of the first portion 2201, and the second terminal 2202B is coupled to the first terminal 220A of the second loop shaped antenna 220. The third portion 2203 may include a first terminal 2203A and a second terminal 2203B where the first terminal 2203A is coupled to the second terminal 2201B of the first portion 2201, and the second terminal 2203B is coupled to the second terminal 220B of the second loop shaped antenna 220. Like FIG. 4, since the second loop shaped antenna 220 of FIG. 5 is a loop antenna, the perimeter P2 (not shown in FIG. 5) of the second loop shaped antenna 220 of FIG. 5 may be a multiple of a second wavelength λ2.

Figure 6:
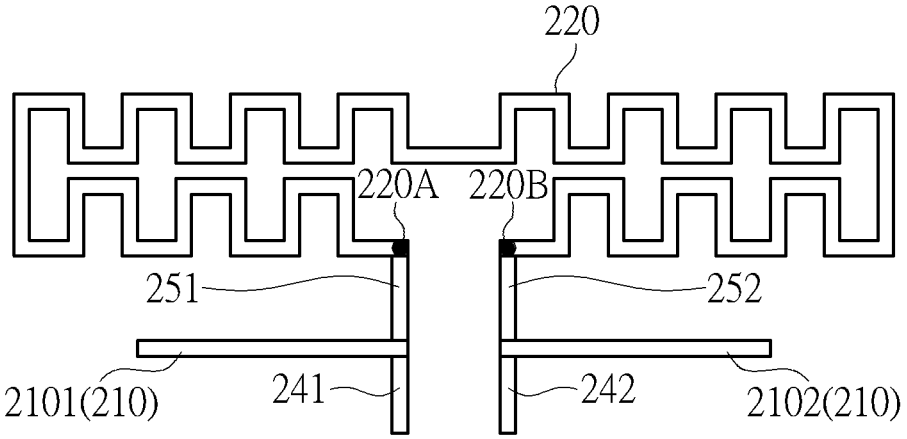
FIG. 6 illustrates the first dipole antenna and the second loop shaped antenna of FIG. 2 according to another embodiment.

FIG. 6 illustrates the first dipole antenna 210 and the second loop shaped antenna 220 of FIG. 2 according to another embodiment of the disclosure. In FIG. 6, the antennas 210 and 220 may be illustrated from a top view or a side view. The second loop shaped antenna 220 of FIG. 6 is a loop antenna which has a perimeter P2 equal to a multiple of a second wavelength λ2. As shown in FIG. 6, the second loop shaped antenna 220 may have a serpentine shape, a rectangular serpentine shape or a zigzag shape. The shapes of the second loop shaped antenna 220 in FIG. 4, FIG. 5 and FIG. 6 are merely examples instead of limiting the shape of the second loop shaped antenna 220.

Similar to the above, when the first projection length L1 of the first dipole antenna 210 is greater than the perimeter P2 of the second loop shaped antenna 220 (which is a loop antenna), the first wavelength λ1 is greater than the second wavelength λ2, and the first frequency band is lower than the second frequency band. When the first projection length L1 of the first dipole antenna 210 is smaller than the half perimeter P2/2 of the second loop shaped antenna 220, the first wavelength λ1 is smaller than the second wavelength λ2, and the first frequency band is higher than the second frequency band.

According to an embodiment, the first dipole antenna 210 and the second loop shaped antenna 220 may be formed on a same conductive layer. For example, the antennas 210 and 220 may be formed by means of the layout of a conductive layer. In this case, the first dipole antenna 210 and the second loop shaped antenna 220 may be substantially coplanar. In this case, the abovementioned connectors 251 and 252 may be formed on the same conductive layer of the antennas 210 and 220. The supporters 241 and 242 may be formed to be orthogonal to the antennas 210 and 220. For example, when the antennas 210 and 220 are formed on a conductive layer of a multiple layer circuit board such as a printed circuit board (PCB), the supporters 241 and 242 may be formed using vias between conductive layers.

According to another embodiment, the first dipole antenna 210 and the second loop shaped antenna 220 may be formed on different conductive layers. According to an embodiment, the first dipole antenna 210 may be formed below the second loop shaped antenna 220. By adjusting the shape of the connectors 251 and 252, the first dipole antenna 210 may be formed directly below the second loop shaped antenna 220. According to other embodiments, from a top view, the first dipole antenna 210 and the second loop shaped antenna 220 may be formed without overlapping one another or with partially overlapping one another. Here, the antennas 210 and 220 may not be in direct contact with each other, but are connected by the connectors 251 and 252.

Figure 7:
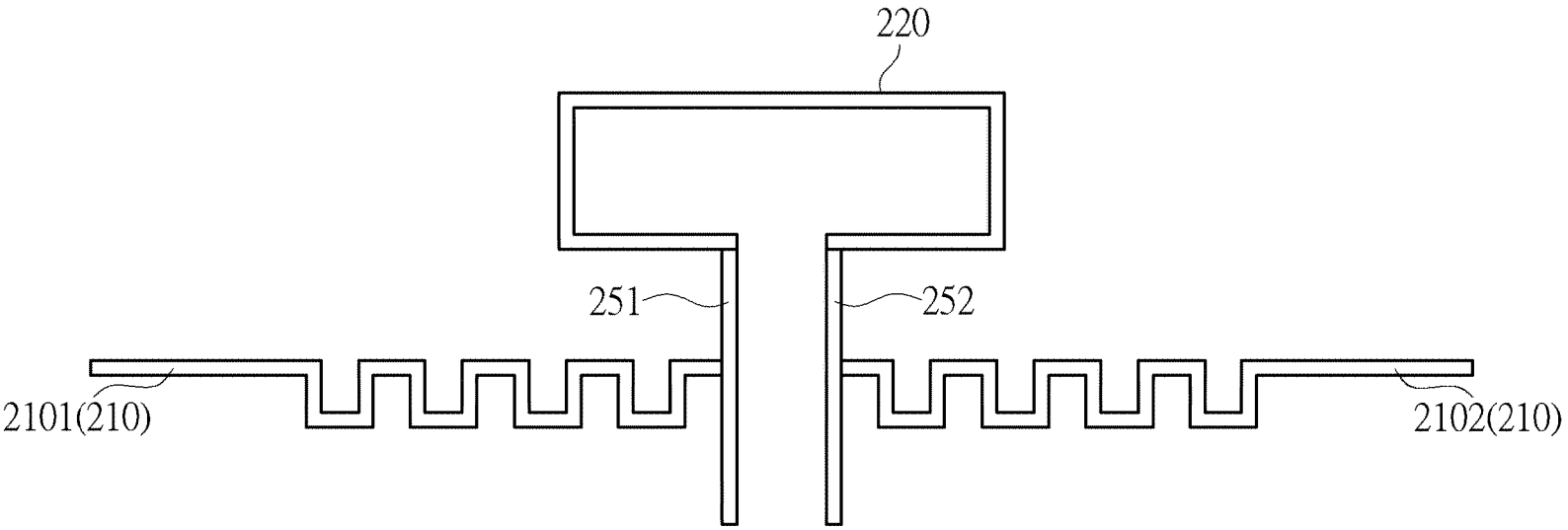
FIG. 7 illustrates the first dipole antenna and the second loop shaped antenna of FIG. 2 according to another embodiment.

FIG. 7 illustrates the first dipole antenna 210 and the second loop shaped antenna 220 of FIG. 2 according to another embodiment of the disclosure. In FIG. 7, the antennas 210 and 220 may be illustrated from a top view or a side view. As shown in FIG. 7, at least one of the first portion 2101 and the second portion 2102 of the first dipole antenna 210 may have a winding shape such as a serpentine shape, a rectangular serpentine shape, a zigzag shape or an irregular shape. According to another embodiment, at least one of the first portion 2101 and the second portion 2102 of the first dipole antenna 210 may have a straight segment as shown in FIG. 2 and FIG. 5.

According to an embodiment, the first portion 2101 and the second portion 2102 of the first dipole antenna 210 may have the same length. For example, as shown in FIG. 5, the first portion 2101 and the second portion 2102 of the first dipole antenna 210 may substantially have the same length.

Figure 8:
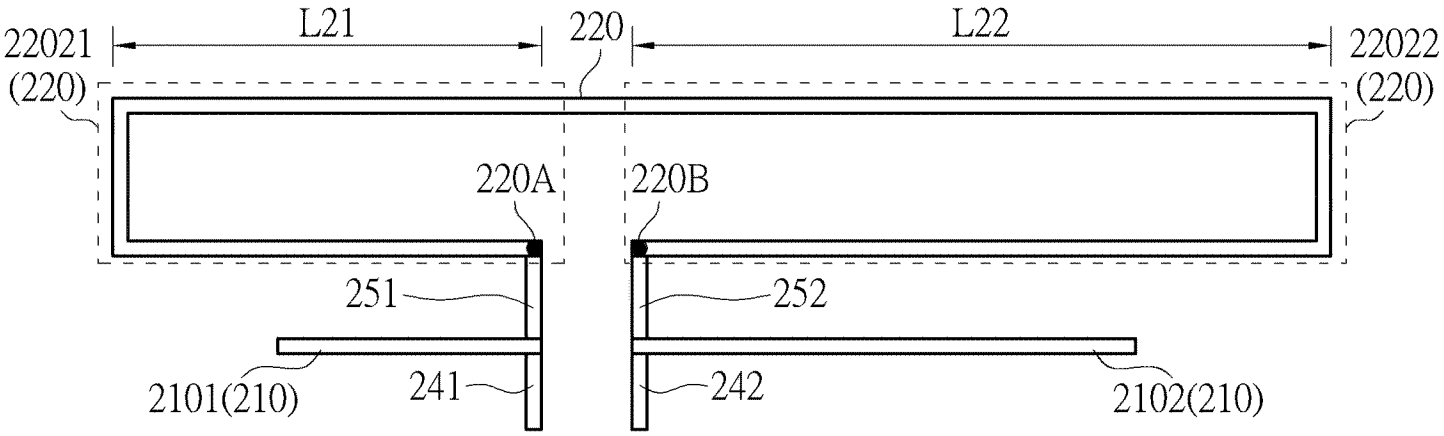
FIG. 8 illustrates the first dipole antenna and the second loop shaped antenna of FIG. 2 according to another embodiment.

According to another embodiment, the first portion 2101 and the second portion 2102 of the first dipole antenna 210 may have two different lengths. FIG. 8 illustrates the first dipole antenna 210 and the second loop shaped antenna 220 of FIG. 2 according to another embodiment. As shown in FIG. 8, the length of the first portion 2101 may be smaller than the length of the second portion 2102. In addition, according to an embodiment, two portions of the second loop shaped antenna 220 corresponding to the first terminal 220A and the second terminal 220B may have two different spans. For example, as shown in FIG. 8, a first portion 22021 and a second portion 22022 of the second loop shaped antenna 220 may have two different spans (lengths) L21 and L22. According to the embodiments of the disclosure, one of the first portion 22021 and the second portion 22022 of the second loop shaped antenna 220 may have a straight segment and/or a winding shape, and the first portion 22021 and the second portion 22022 may have two different lengths or a same length.

Figure 9:
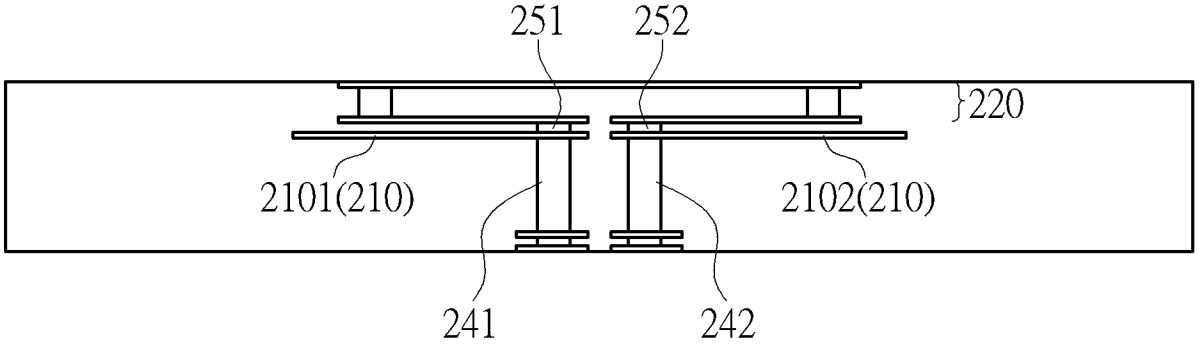
FIG. 9 illustrates the antennas, the connectors and the supporters of FIG. 2 according to an embodiment.
Figure 10:
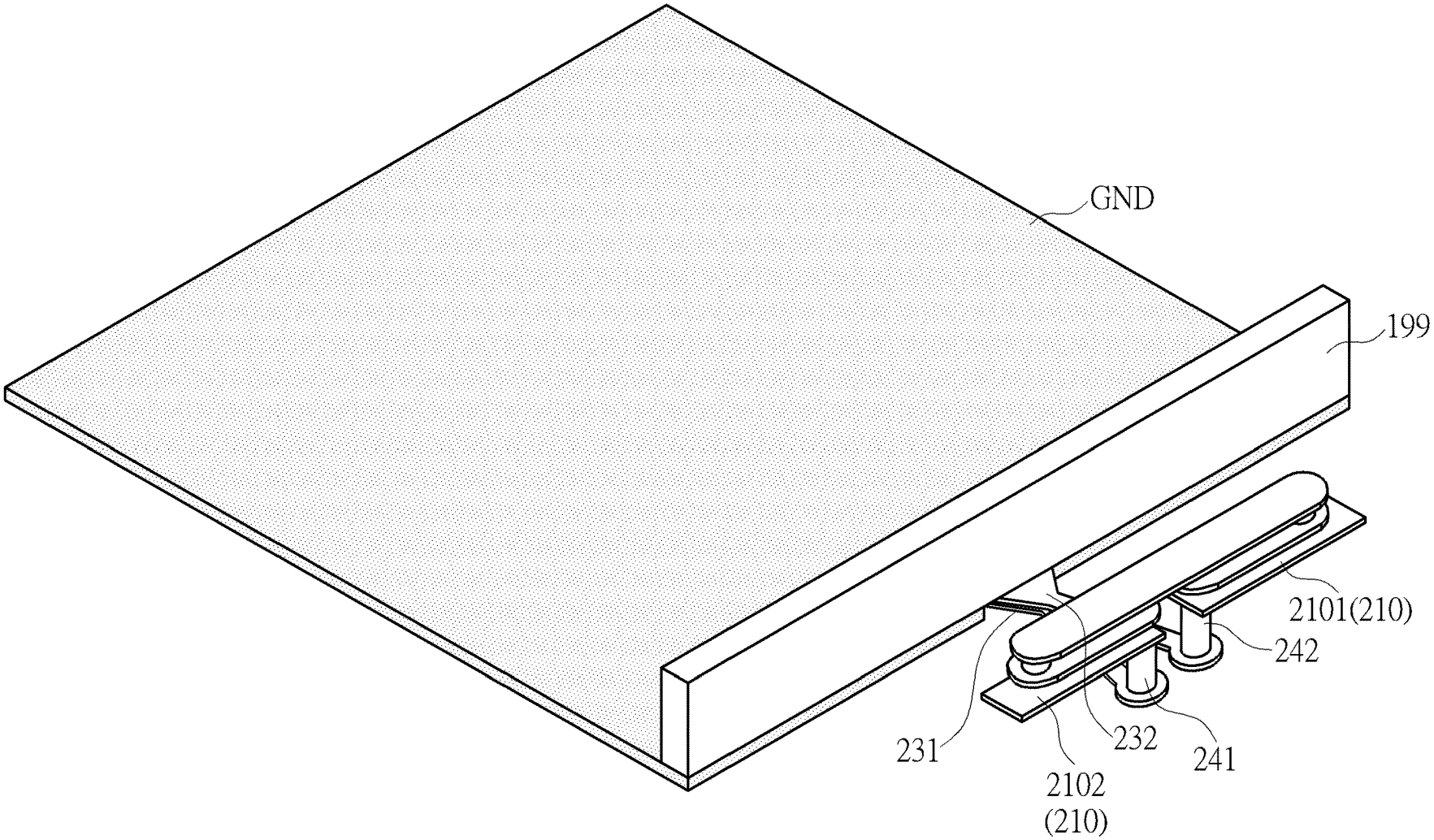
FIG. 10 illustrates the antenna device of FIG. 2 from a perspective view according to an embodiment.
Figure 11:
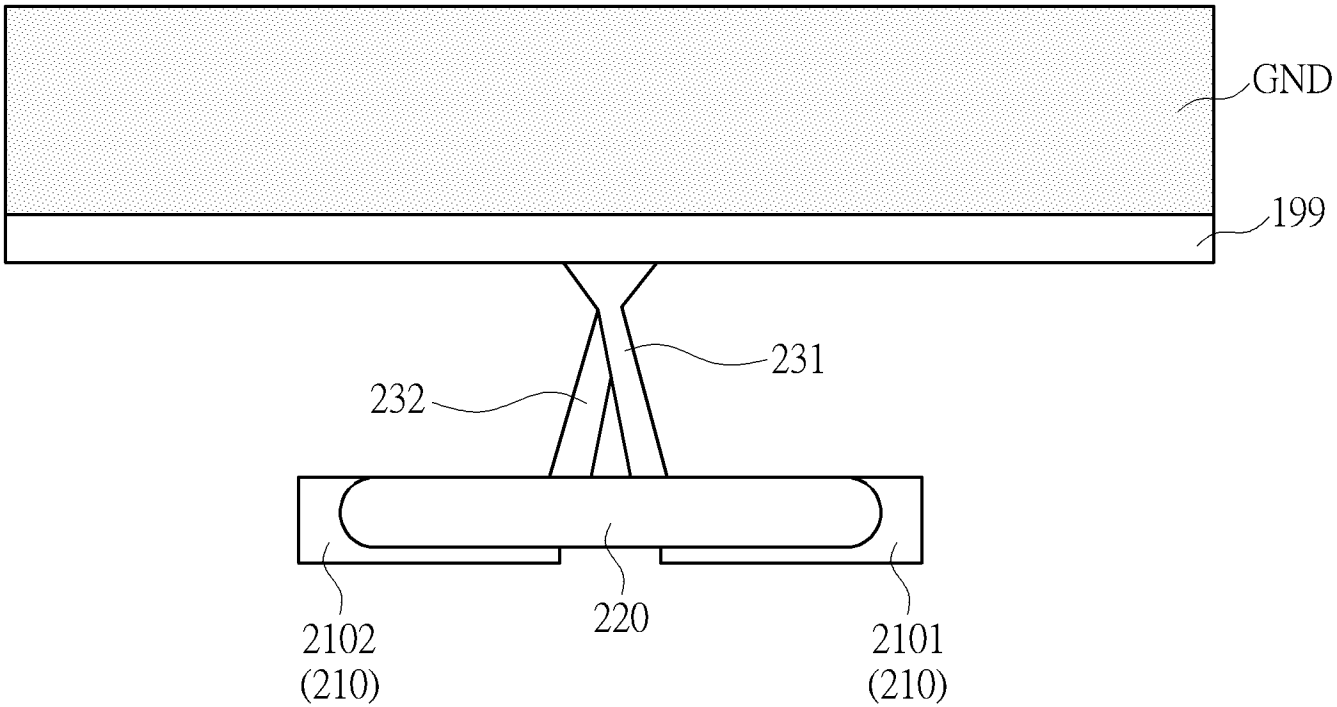
FIG. 11 illustrates the antenna device of FIG. 10 from a top view.

In FIG. 2 to FIG. 8, the antennas 210 and 220 are simplified for illustrating the principles of design. FIG. 9 to FIG. 11 may provide structural diagrams that are more similar to an actual structure.

FIG. 9 illustrates the antennas 210 and 220, the connectors 251 and 252 and the supporters 241 and 242 of FIG. 2 according to an embodiment of the disclosure. In FIG. 9, the antennas, connectors and the supporters may be shown from a side view and be formed using different layers and vias of a circuit board. FIG. 10 illustrates the antenna device 200 of FIG. 2 from a perspective view according to an embodiment of the disclosure. In addition to the antennas 210 and 220, the connectors 251 and 252, the supporters 241 and 242, and the feed lines 231 and 232 mentioned above, the antenna device 200 may further include a wall body 199 as a reflector for reflecting a wireless signal transceived by the first dipole antenna 210 and/or the second loop shaped antenna 220. As shown in FIG. 10, the wall body 199 may be disposed on the ground plane GND or on a suitable baseboard. The wall body 199 may be formed using different layers and vias of a circuit board. FIG. 11 illustrates the antenna device 200 of FIG. 10 from a top view for showing the structure clearly.

Figure 12:
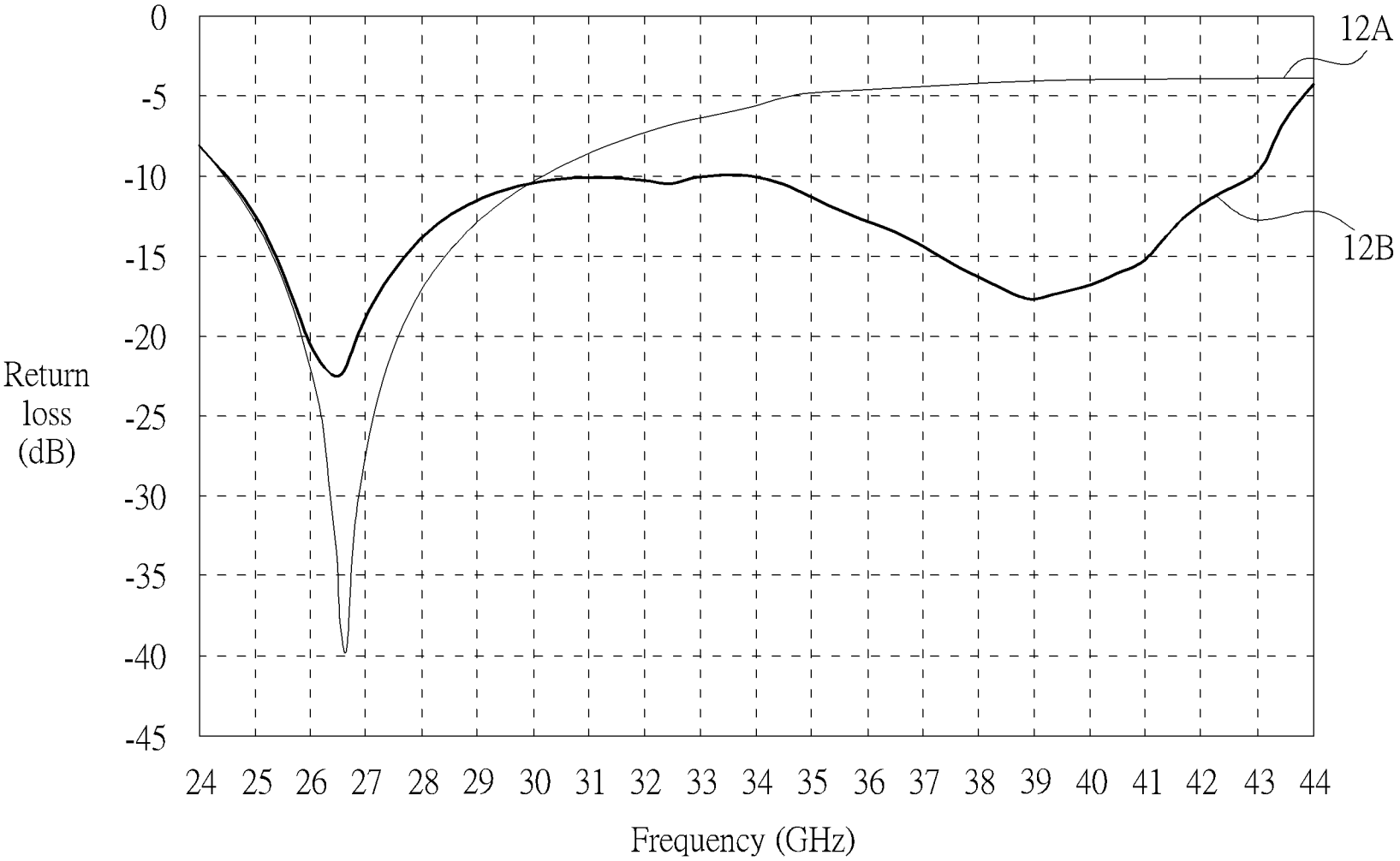
FIG. 12 illustrates waveforms diagram of return loss vs. frequency according to an embodiment.
Figure 13:
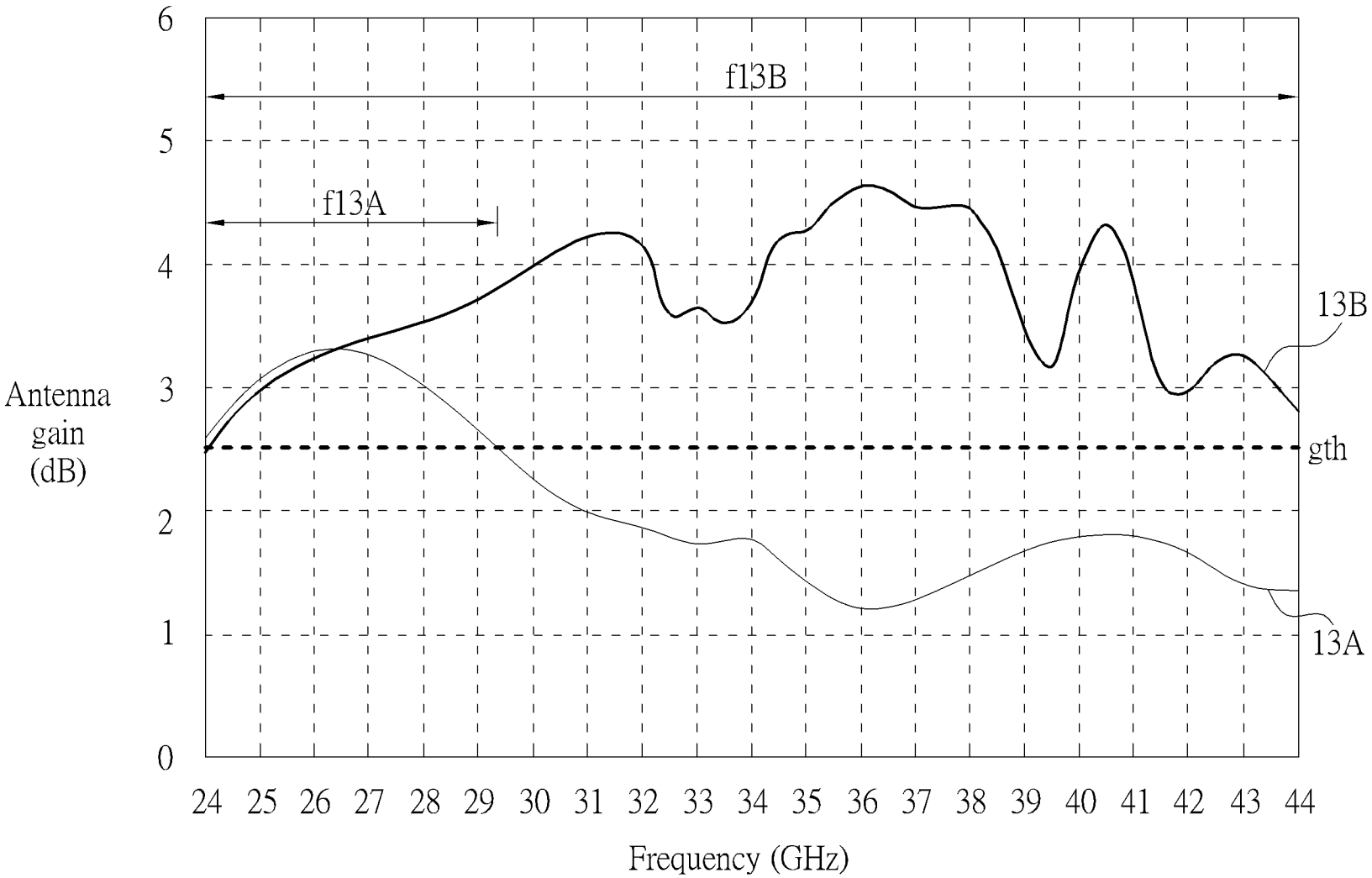
FIG. 13 illustrates waveforms of antenna gain vs. frequency according to an embodiment.

FIG. 12 illustrates frequency response of return loss according to an embodiment of the disclosure. FIG. 13 illustrates frequency response of antenna gain vs. frequency according to an embodiment of the disclosure.

In FIG. 12, the curve 12A is the return loss (also known as "S11" in the S-Parameters) without using the antenna device 200 of FIG. 2, and the curve 12B is the return loss by means of the antenna device 200. As shown by the curve 12A, there is merely one resonance frequency band without using the antenna device 200. However, as shown by the curve 12B, there are two resonance frequency bands by means of the antenna device 200, and the frequency bandwidths are effectively widen.

In FIG. 13, the curve 13A is the antenna gain without using the antenna device 200 of FIG. 2, and the curve 13B is the antenna gain by means of the antenna device 200. As shown by the curve 13A, the antenna gain is acceptable merely within a narrower frequency band (e.g. the band f13A), but the antenna gain of other frequency bands is extremely low. For example, the antenna gain is lower than a threshold gth according to the curve 13A. However, as shown by the curve 13B, by means of the antenna device 200, the antenna gain is improved. For example, the antenna gain shown by the curve 13B is larger than the threshold gth within a frequency band (e.g. the band f13B) wider than the band f13A.

In summary, by means of the antenna device 200 provided by an embodiment, the first dipole antenna 210 and the second loop shaped antenna 220 can be integrated to form an antenna device capable of transceiving signals at two frequency bands, and both return loss and antenna gain can be improved. Moreover, by means of the antenna device 200, two antennas can be well integrated without increasing hardware size in a large degree. Hence, the antenna device 200 is useful for dealing with problems in the field and improving antenna gain and antenna bandwidth.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna device comprising:

a first dipole antenna configured to operate at a first frequency band, the first dipole antenna comprising a first portion and a second portion, the first portion having a first terminal and a second terminal, and the second portion having a first terminal and a second terminal;

a second loop shaped antenna configured to operate at a second frequency band different from the first frequency band, the second loop shaped antenna comprising a first terminal and a second terminal, the first terminal of the second loop shaped antenna being coupled to the second terminal of the first portion of the first dipole antenna and the second terminal of the second loop shaped antenna being coupled to the first terminal of the second portion of the first dipole antenna, the second loop shaped antenna being the only loop shaped antenna comprised by the antenna device;

a first feed line comprising a first terminal coupled to the second terminal of the first portion of the first dipole antenna, and a second terminal; and a second feed line comprising a first terminal coupled to the first terminal of the second portion of the first dipole antenna, and a second terminal wherein:

the second loop shaped antenna is a folded dipole antenna;

a second projection length of the second loop shaped antenna is substantially equal to m times half a second wavelength;

the second wavelength is corresponding to the second frequency band; and m is a positive integer greater than zero.

2. The antenna device of claim 1 further comprising:

a first supporter disposed between the first terminal of the first feed line and the second terminal of the first portion of the first dipole antenna; and a second supporter disposed between the first terminal of the second feed line and the first terminal of the second portion of the first dipole antenna.

3. The antenna device of claim 1, wherein:

a first projection length from the first terminal of the first portion of the first dipole antenna to the second terminal of the second portion of the first dipole antenna is substantially equal to n times half a first wavelength;

the first wavelength is corresponding to the first frequency band; and n is a positive integer greater than zero.

4. The antenna device of claim 1, wherein the second loop shaped antenna has a symmetrical shape.

5. The antenna device of claim 1, wherein the second loop shaped antenna has a serpentine or zigzag shape.

6. The antenna device of claim 1, wherein:

the second loop shaped antenna is a loop antenna;

a perimeter of the second loop shaped antenna is substantially equal to k times the second wavelength; and k is a positive integer greater than zero.

7. The antenna device of claim 6, wherein the second loop shaped antenna has a symmetrical shape.

8. The antenna device of claim 6, wherein the second loop shaped antenna comprises:

a first portion comprising a first terminal and a second terminal;

a second portion comprising a first terminal coupled to the first terminal of the first portion of the second loop shaped antenna, and a second terminal coupled to the first terminal of the second loop shaped antenna; and a third portion comprising a first terminal coupled to the second terminal of the first portion of the second loop shaped antenna, and a second terminal coupled to the second terminal of the second loop shaped antenna.

9. The antenna device of claim 6, wherein the second loop shaped antenna has a serpentine or zigzag shape.

10. The antenna device of claim 1, further comprising:

a first connector coupled between the first terminal of the second loop shaped antenna and the second terminal of the first portion of the first dipole antenna; and a second connector coupled between the second terminal of the second loop shaped antenna and the first terminal of the second portion of the first dipole antenna.

11. The antenna device of claim 1, wherein the first dipole antenna and the second loop shaped antenna are formed on a same conductive layer.

12. The antenna device of claim 1, wherein the first dipole antenna and the second loop shaped antenna are formed on different conductive layers.

13. The antenna device of claim 1, wherein:

one of the first feed line and the second feed line is configured to transceive a signal; and another one of the first feed line and the second feed line is configured to a reference ground.

14. The antenna device of claim 1, wherein:

one of the first feed line and the second feed line is configured to transceive a first signal;

another one of the first feed line and the second feed line is configured to transceive a second signal; and the first signal and the second signal form a pair of differential signals.

15. The antenna device of claim 1, wherein:

the first portion and the second portion of the first dipole antenna have two different lengths; and/or a first portion and a second portion of the second loop shaped antenna have two different lengths.

16. The antenna device of claim 1, wherein:

the first portion and the second portion of the first dipole antenna have a same length; and/or a first portion and a second portion of the second loop shaped antenna have a same length.

17. The antenna device of claim 1, wherein:

one of the first portion and the second portion of the first dipole antenna is a straight segment; and/or the second loop shaped antenna has a straight segment.

18. The antenna device of claim 1, wherein:

one of the first portion and the second portion of the first dipole antenna has a winding shape; and/or the second loop shaped antenna has a winding shape.

19. The antenna device of claim 1, further comprising:

a wall body configured to reflect a wireless signal transceived by the first dipole antenna and/or the second loop shaped antenna.

* * * * *